United States Patent [19]

Green, Jr.

[11] 4,091,384

[45] May 23, 1978

[54] MONITORING ALARM SYSTEM

[75] Inventor: Donald C. Green, Jr., Whitehouse, Tex.

[73] Assignee: Donald C. Green, Sr., Tyler, Tex. ; a part interest

[21] Appl. No.: 715,204

[22] Filed: Aug. 17, 1976

[51] Int. Cl.[2] ..... G08B 13/22

[52] U.S. Cl. ..... 340/416; 340/248 B

[58] Field of Search ..... 340/213, 213.1, 213.2, 340/222, 248 B, 276, 412, 414, 416, 418; 179/5 R

[56] References Cited

U.S. PATENT DOCUMENTS

| | | | |
|---|---|---|---|
| 3,369,079 | 2/1968 | Glidden | 179/5 |
| 3,412,392 | 11/1968 | Jenkins et al. | 340/248 |
| 3,449,737 | 6/1969 | Stewart | 340/248 |
| 3,488,650 | 1/1970 | Muchnick | 340/248 |
| 3,544,986 | 12/1970 | Earling et al. | 340/253 |
| 3,573,780 | 4/1971 | Butterbaugh | 340/248 |
| 3,707,708 | 12/1972 | Dan | 340/213.2 |
| 3,757,323 | 9/1973 | Pintell | 340/416 |
| 3,767,867 | 10/1973 | Altenberger | 179/175.25 |
| 3,882,278 | 5/1975 | Coll | 179/5 R |
| 3,924,254 | 12/1975 | Klebold et al. | 340/261 |

*Primary Examiner*—Alvin H. Waring

*Attorney, Agent, or Firm*—Cushman, Darby & Cushman

[57] ABSTRACT

An alarm system, including a first station at a site to be monitored, and a second station at a site for monitoring the first station, and phone lines inter-connecting the first and second stations. First and second alarm control assemblies are provided in the first station responsive to different alarm initiating conditions. A first indicator in the second station indicates a first alarm condition by a first mode of operation thereof, and indicates a second alarm condition by a second mode of operation thereof. A second indicating means in the second station indicates a third alarm condition by a mode of operation thereof. First circuitry connected to the phone lines effects energization of the second-indicating means should the voltage of the phone lines be lost, and second circuitry connected to the phone lines effects operation of the first indicator in the first mode thereof in response to actuation of the first alarm control assembly and effects operation of the first indicator in the second mode thereof, in response to actuation of the second alarm control system. A switch in the second station is utilized for resetting portions of the second circuitry which effect operation of the first indicator in the first mode thereof, and the switch also controls actuation of a load at the first station whether or not the first alarm control system is actuated. A third indicator, such as a sonic indicator, also is actuated when either of the first or second indicators are actuated, and circuitry is provided for silencing the sonic alarm once the alarm has been recognized.

23 Claims, 1 Drawing Figure

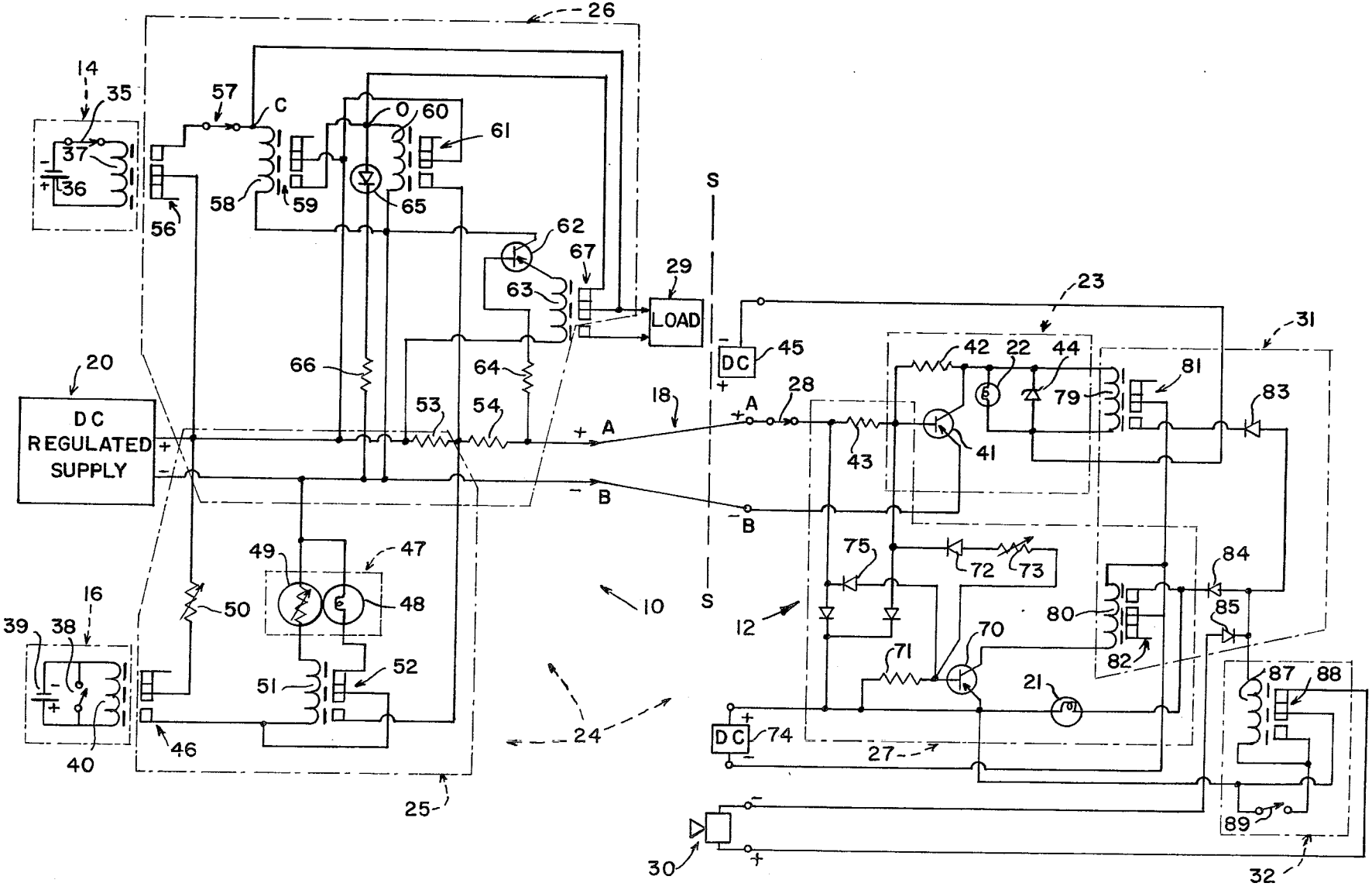
LOAD
DC
DC
DC REGULATED SUPPLY

MONITORING ALARM SYSTEM

BACKGROUND AND SUMMARY OF THE INVENTION

The invention relates to an alarm system that provides protection against multiple alarm-initiating conditions, provides clear distinction between the alarm-initiating conditions that are protected against, utilizes conventional leased phone lines to provide monitoring of a site to be protected, and can be utilized to control load sources at the protected site from the monitoring site.

While there have been numerous prior art proposals for utilization of phone lines between protected and monitored sites such as shown in U.S. Pat. Nos. 3,707,708, 3,757,323, and 3,767,867, such systems have been relatively complex in order to provide a wide variety of protective functions, containing a large number of component parts, including a wide variety of indicating means. According to the present invention, however, an alarm system is provided that contains a minimal number of component parts, including a minimum number of indicating means, yet the system according to the present invention is capable of sensing a wide variety of alarm-initiating conditions, distinguishing between such conditions when the distinctions require different types of action to be taken in the monitoring station, and utilize only conventional phone lines (while also monitoring the phone lines) to provide the transmitting and protective functions. Also, according to the present invention, a degree of control over the alarm-initiating means in the protected site, and various loads in the protected sight (i.e., floodlights) is provided at the monitoring site, and all of the sensing apparatus employed is sensitive to voltage changes, even the slightest voltage change occasioning activation of alarm-indicating means.

According to the present invention, an alarm system is provided comprising a first station in a site to be monitored, a second station in a site to monitor the first station, a first alarm control means in the first station, a second alarm control means in the first station, phone lines inter-connecting the first station and the second station and adapted to be connected to a source of D.C. electric power for applying voltage thereto, a first-indicating means in the second station for indicating the first alarm condition by a first mode of operation thereof, and for indicating the second alarm condition by a second mode of operation thereof, a second-indicating means in the second station for indicating at least a third alarm condition by a mode of operation thereof, first circuit means connected to the phone lines for effecting energization of the second-indicating means should the voltage of the phone lines be lost, and second circuit means connected to the phone lines for effecting operation of the first-indicating means in the first mode thereof in response to actuation of the first alarm control means, and for effecting operation of the first-indicating means in the second mode thereof in response to actuation of the second alarm control means. The second circuit means includes means for effecting operation of the first-indicating means in the first mode thereof in response to a source of D.C. current being placed closer to the second station than the first station on the phone lines, and each of the alarm control means includes condition sensing means, the first alarm control means preferably including intrusion-sensing means. Since the placement of a D.C. current source closer to the second station than the first station on the phone lines is normally a prelude to intrusion, intrusion is indicated both by actual intrusion of the first station and by such placing of a D.C. source. The first and second circuit means comprise means for effecting operation of both the first and second-indicating means should the polarity of the phone lines reverse. In this way, then, two indicating means provide for five different alarm initiating conditions, four of such conditions being readily distinguishable, and the fifth condition being directly related to one of the other four conditions so that the same response is required thereby at the monitoring station.

Switch means are provided at the second station for effecting operation of the second circuit means for energizing a load remote from the second station, whether or not the first control means is actuated. Second circuitry component means of the second circuit provides latching of the first-indicating means in the first mode in response to actuation of the first alarm control means, and the same switch means that is utilized for effecting remote load control is also utilizable for effecting release of the latching of the first-indicating means if and when the first alarm control means is no longer actuated.

A third-indicating means, such as a sonic alarm, also is provided in the second station for indicating all of said first, second, and third alarm conditions, and means are provided for actuating the third-indicating means whenever the first or second indicating means are actuated. A selective deactivating means is also provided for the third-indicating means so that the third-indicating means may be deactivated while the first and second indicating means are still active.

The first and second circuitry means for actuating the first and second indicating means are responsive to voltage changes and provide actuation of the first and second indicating means dependent upon voltage changes. The second circuit means preferably includes first and second circuit component means located at the first station, and third component means located at the second station. The first circuit component means effects latched-on operation of the first-indicating means in the first mode thereof, the second circuit component means effects operation of the first-indicating means in the second mode of operation thereof, and the third circuit component means, which is utilized both with the first and second circuit component means, effects operation of the first-indicating means in the first mode thereof when the polarity in the phone lines reverses. The third circuit component means includes a transistor with a biasing resistor, and a variable resistor means for providing a threshold adjustment for the transistor so that the transistor will conduct, upon the sensing of only an infinitesimal voltage change. The variable resistor is adjusted to any sensitivity desired. The voltage drop across the resistor in the phone lines is sensed by the third circuit component means.

It is the primary object of the present invention to provide an effective, multiple-alarm initiating condition sensing alarm system utilizing a minimum number of parts, and providing for a variety of control and accessory alarm actuating functions. This and other objects of the invention will become clear from an inspection of the detailed description of the invention, and from the appended claims.

BRIEF DESCRIPTION OF THE DRAWING

The drawing is a circuit diagram of an exemplary alarm control system according to the present invention, various functioning control parts thereof being bordered in dotted line.

DETAILED DESCRIPTION OF THE INVENTION

The following reference numerals in the drawing indicate the corresponding elements:

| | | | |
|---|---|---|---|
| 10 | a first station | 12 | a second station |
| 14 | a first alarm control means | 16 | a second alarm control means |
| 18 | phone lines | 20 | a DC source |
| 21 | a first indicating means | 22 | a second indicating means |
| 23 | first circuit means | 24 | second circuit means |
| 25 | first circuit component means for 24 | 26 | second circuit component means for 24 |
| 27 | third circuit component means for 24 | 28 | switch means |
| 29 | a load | 30 | third indicating means |
| 31 | means for actuating 30 | 32 | deactivating means for 30 |
| 35 | one or more condition responsive switching sensors | 36 | emf source |
| 37 | first alarm control coil | 38 | one or more condition responsive switches |
| 39 | emf source | 40 | second alarm control coil |
| 41 | transistor | 42 | transistor biasing resistor |
| 43 | isolating-voltage drop resistor | 44 | Zener diode |
| 45 | transistor 41 DC source | 46 | relay contacts |
| 47 | light-tight enclosure | 48 | light source |
| 49 | photo resistor | 50 | variable resistor |
| 51 | photo resistor coil | 52 | oscillator relay contacts |
| 53 | resistor (voltage drop) | 54 | resistor (voltage drop) |
| 56 | relay contacts | 57 | manual switch |
| 58 | coil | 59 | relay contacts |
| 60 | coil | 61 | relay contacts |
| 62 | latching transistor | 63 | coil |
| 64 | transistor biasing resistor | 65 | light emitting diode |
| 66 | series dropping resistor | 67 | relay contacts, load control |
| 70 | transistor | 71 | transistor biasing resistor |
| 72 | diode | 73 | variable resistor (finely adjustable) |
| 74 | low-voltage DC source | 75 | diode |
| 79, 80 | coils | 81, 82 | relay contacts |
| 83, 84, 85 | diodes | 87 | coil |
| 88 | latching relay contacts | 89 | manual switch |

An exemplary alarm control system, according to the present invention, is shown schematically in the drawing. The primary components of the alarm system include a first station 10 in a site to be monitored (on the left side of lines S—S in the drawing), and a second station 12 in a site to monitor the first station (on the right side of lines S—S in the drawing), a first alarm control means 14 in the first station 10, a second alarm control means 16 in the first station 10, phone lines 18 inter-connecting the first station 10 and the second station 12, and adapted to be connected to a source (12 volt) of D.C. electric power 20 for applying the voltage thereto, a first-indicating means 21 in the second station 12 for indicating a first alarm condition by a first mode of operation thereof, and for indicating a second alarm condition by a second mode of operation thereof, a second-indicating means 22 in the second station 12 for indicating at least a third alarm condition by a mode of operation thereof, first circuit means 23 connected to the phone lines 18 for effecting energization of said second-indicating means 22 should the voltage of the phone lines be lost, and second circuit means 24 operatively-connected to the phone lines 18 for effecting operation of the first-indicating means 21 in the first mode thereof in response to actuation of the first alarm control means 14, and for effecting operation of the first-indicating means 21 in the second mode of operation thereof in response to actuation of the second alarm control means 16. The second circuit means includes first, second, and third circuit component means 25, 26 and 27, respectively, the first and second circuit component means 25, 26 being disposed at the first station 10, and the third circuit component means 27 being disposed at the second station 12. Other important components of the exemplary form of the invention shown in the drawing includes switch means 28 located in the second station 12, the switch means 28 comprising means for effecting release of latching of the first-indicating means 21 in the first mode of operation thereof, once the first alarm control means 14 is no longer actuated, and means for effecting operation of the second circuit component means 26 of the second circuit means 24 for energizing a load 29 remote from the second station, whether or not the first alarm control means 14 is actuated. A third-indicating means 30 is also provided, including means 31 for actuating the third-indicating means whenever the first or second-indicating means 21, 22, respectively, are actuated, and means 32 for selectively deactivating the third-indicating means 30 while not deactivating the first and second-indicating means 21, 22, respectively.

The first station 10 generally would be a house, business establishment, or other structure to be protected, while the second station 12 would be at a point remote from the first station 10 which would have the capability of responding to alarm conditions in the first station 10, such as a police station, commercial security company, etc. The first alarm control means 14 includes one or more condition-responsive sensors 35 for sensing an alarm-initiating condition. Preferably, the sensors 31 would be intrusion sensors which would indicate when an attempt was made to break into a building at the station 10. A source 36 of emf and a first alarm control coil 37 are also provided as part of the first alarm control means 14, the sensors 35 normally being closed, but, upon opening thereof, the coil 37 being deactivated to, in turn, initiate a response by the second circuit component means 26 of the second circuit means 24. The second alarm control means 16 includes one or more condition-responsive sensors 38 which are responsive to a different alarm-initiating condition than the sensors 35, such as fire. As shown in the drawings, the second sensing means 38 may normally be open but, upon closure thereof, deenergizing coil 40 and, thereby effecting a controlled response by first circuit component means 25 of second circuit means 24.

The phone lines 18 inter-connecting the stations 10 and 12 are preferably conventional leased phone lines, and a 12 volt D.C. regulated supply 20 is connected to the phone lines 18, points A in stations 10 and 12 being the plus sides of the regulated supply, and points B in stations 10 and 12 being connected to the negative sides of the supply 20. The first-indicating means 21 preferably includes an indicator light, the light having a constantly-on actuated position as the first mode of operation thereof, and a flashing on and off-actuated condition as the second mode of operation thereof. Preferably, control of which mode of operation the indicator light 21 will be in is provided by the first and second circuit component means 25, 26 of the second circuit means 24. The second-indicating means 22 also preferably includes an indicator light, control of that indicator light, of course, being provided by the first circuit means 23.

The first circuit means 23 preferably includes a transistor 41 connected to a transistor-biasing resistor 42, and a Zener diode 44 placed in parallel with the indicator light 22. The resistor 43 isolates the base of transistor 41 from the monitored voltage, and, additionally, has a voltage drop there-across determined by the voltage applied to points A and B.

The first circuit component means 25 of the second circuit means 24 is responsive to the second alarm control means 16, and provides for oscillating the voltage applied to the first indicator means 21 to operate the indicator light 21 in the flashing on and off second mode of operation thereof. Oscillation of the voltage transmitted by the phone lines 18, and, thus, the current supplied to the indicator light 21, is generally provided by the light-tight photo-oscillator arrangement 47 and the components associated therewith. Disposed within the light-tight enclosure 47 is a light source 48 and a photo-resistor 49, the photo-resistor 49 being connected to a coil 51, and the light source 48 being connected to a set of relay contacts 52. The variable resistor 50 serves to limit the amount of voltage applied to the coil 51 and, by doing so, the rate at which the relay contacts 52 switch on and off. Adjustment of the variable resistor 50 thus adjusts the frequency of on and off flashing of the indicator light 21. The resistors 53 and 54 each have a voltage drop there-across, shunting of either of the resistors 53 or 54 resulting in a change in voltage in the lines 18, and the resistors 53, 54 comprise components of both first circuit component means 25 and second circuit component means 26.

The second circuit component means 26 of the second circuit means 24 includes relay contacts 56 which are responsive to the control of the coil 37 of first alarm means 14, and on/off switch 57, which may be manually actuated to either cut-out or cut-in the first alarm control means 14, a coil 58 in relay contacts 59 actuated thereby, another coil 60 and relay contacts 61 actuated thereby, a transistor 62 biased by resistor 64, and another coil 63 connected to transistor 62. The light-emitting diode 65, connected to a series dropping resistor 66, provides a visible indication of when the second circuit component means 26 of second circuitry means 24 is put in an alarm condition by the first alarm control means 14.

The switch means 28 for releasing latching of the first-indicating means 21 in the first mode of operation thereof, and for controlling the load 29 through the second circuit component means 26 of second circuit means 24 preferably includes a simple normally-closed manually-actuable on/off switch 28. The load 29 to be controlled thereby may be any suitable load, such as flood lights disposed exteriorly of the building at the first station 10, or illuminating lights in the building at first station 10. In this way, an individual at the monitoring station 12 may selectively and randomly control the lights at the monitored site 10, for instance, when the monitored site 10 is to be vacant for a long period of time, thus discouraging attempts to intrude the station 10. Relay contacts 67 provide both for control of the latching of first-indicating means 21 in its first mode of operation, and for operation of the load 29.

The third circuit component means 27 of the second circuit means 24 includes a transistor 70, biased by resistor 71, for sensing a change in the voltage drop across resistor 43. A diode 72 and threshold adjustment variable resistor 73 are connected to the base of the transistor 70 and to the resistor 43. Variable resistor 73 can be so adjusted that the transistor 70 is on the "edge" of conducting, so that any infinitesimal increase in the voltage drop across resistor 43 will cause transistor 70 to conduct. If any attempt were made to place a DC source closer to the monitoring site 12 than the monitored site 10 (in preparation for disconnecting the protected site 10) the voltage drop across resistor 43 would increase, and this, too, would be sensed by the transistor 70, operating indicator light 21 in the first mode of operation thereof. Should the voltage at points A and B reverse, the negative voltage at point B would pass through the diode 75 and be applied to the base of transistor 72, which would also illuminate indicator light 21, and the same voltage reversal would cause transistor 41 to conduct and illuminate second-indicator light 22.

The DC source 45 preferably is of the same voltage as the DC voltage applied by regulated supply 20 — i.e., 12 volts — and this source provides power for the transistor 41, and the first-indicating means 22. The DC source 74 preferably is a lower voltage DC source (i.e., 6 volts) and this provides power for the transistor 70 and the first-indicating means 21, as well as the third-indicating means 30. The means 30 preferably includes any suitable sonic indicator, and the actuating means 31 therefor may include latching or non-latching indicating means (that is either not terminating or terminating upon sessation of the alarm-initiating condition). Coils 79 and 80, respectively, control relay contacts 81 and 82 for actuation of the indicating means 30 through diodes 83 and 84, respectively, and diode 85. The coil 79 is powered by the source 45, being operatively connected to the transistor 41 and having the voltage there-across regulated by Zener diode 44 of first-circuit means 23. When the indicator light 22 is energized, coil 79 causes relay contacts 81 to switch over, which, in turn, causes power from source 74 to be applied to sonic-indicating means 30. Coil 80 is operatively connected to transistor 70, and when current is supplied thereto from source 74, contacts 82 are actuated, which cause current to be passed to the sonic-indicating means 30.

The selective deactivating means 32 for the sonic-indicating means 30 includes a coil 87 operatively connected to diodes 83 and 84, relay contacts 88, operatively connected to the indicator 30, and a manual normally-open switch 89. Upon actuation of the switch 89, the coil 87 is temporarily energized which latches the contacts 88 so that no current can flow to the indicating means 30, and, once this occurs, the indicating means 30 will not again actuate, no matter what the position of the switch 89, until the system has been reset by termination of the alarm-initiating conditions and/or use of resetting switch 28.

Exemplary structure, according to the present invention, having been described, a mode of operation thereof will now be set forth. For the ensuing mode of operation, it will be assumed that the sensors 35 sense intrusion, and the sensors 38 sense a fire, and the load 29 is a series of illuminating lights at the first station 10, although it will be apparent to those of ordinary skill in the art that the system according to the present invention may be used for many other different alarm-initiating conditions, and different control conditions.

Upon an intruder breaking into the protective station 10, sensors 35 are actuated, which cause a switching of the relay contacts 56 so that current flows from source 20 through coil 58. Coil 58, in turn, energizes relay contacts 59, which, in turn, energize coil 60 and relay contacts 61. Contacts 61 cause resistor 53 to be shunted-out, which effects an increase in the output voltage of the telephone lines 18 at point A. With a voltage increase at point A, the voltage drop across resistor 43 changes. Diode 72 passes the negative potential at the junction of resistors 43, 42 through the variable "threshold" resistor 73 to the base of transistor 70. When this negative voltage is greater than the positive bias placed on the base of transistor 70 by the resistor 71, the transistor 70 conducts, causing coil 80 to be actuated, and relay contacts 82 to close, thereby actuating first-indicator light 21. A first "constantly-on" mode of operation of indicator light 21 is effected since the resistor 53 is continuously shunted. This is effected by the transistor 62 and associated structure. When 58 is energized, point D is at a plus-DC potential, which plus-DC potential is also applied to the coil 63, which then applies the plus-DC potential to point C which holds or latches the circuitry into an alarm condition, even if the coil 37 returns to normal. This latching is achieved since 62 is turned in an on condition, causing the contacts 67 to be closed. 62 is biased into an on condition by applying the voltage drops of 53 and 54 to the base of 62. In order to reset or "unlatch" the circuitry once 37 has returned to normal, switch 28 is momentarily opened, causing the voltage drop across resistors 53 and 54 to go to zero, and, thereby, causing the transistor 62 to cease conducting, in turn, causing the contacts 67 to switch and removing the plus potential applied to point C, whereby contacts 59 and 61 also return to their normal position. With these contacts at their normal position, voltage is no longer supplied to first-indicating means 21. It is also noted that when coil 80 actuates relay contacts 82, current flows through diode 84, through diode 85, and actuates audible alarm 30. In order to stop alarm 30 from actuating, while still allowing the constantly-on illumination of light 21, the switch 89 is thrown, whereby current flows through diode 84 to coil 87, causing the latching relay contacts 88 to switch over, which causes the sonic-indicating means 30 to be bypassed.

Should a source of DC electricity be placed closer to the monitoring site 12 and the monitored site 10, which would be a prelude to someone intruding in the station 10, the voltage drop across resistor 43 would increase in a proportional amount of the less series resistance of the original telephone line 18 and the lower resistance of the telephone line 18 between the point where the DC source was applied and the monitoring point. Again, current would flow through diode 72 and variable resistor 73 to cause transistor 70 to conduct, whereupon light 21 would again be energized in its first "constantly-on" mode. Since the variable resistor 73 is a threshold resistor, it can be adjusted so finely that the transistor 70 will sense even the most infinitesimal voltage drop across resistor 43. The source 21 would stay in the first mode of operation thereof (constantly on) until the DC source was removed from a position closer to the monitoring point 12 (or the switch 28 would open). Again, of course, the sonic-indicating means 30 would be actuated.

If a fire were to start at the first station 10, the sensors 38 would be closed, whereby the contacts 46 would switch. When this occurs, the coil 51 will not immediately be energized since the photo-sensitive resistor 49 has an initial very high resistance, and current cannot flow therethrough from the source 20. However, current will flow immediately through the light source 48, which, in turn, will decrease the resistance of the photo-resistor 49, causing current to flow through coil 51, which then effects a switching of the contacts 52. Switching of contacts 52 causes two things to happen—resistor 53 is shunted, causing the voltage on the telephone line 18 to increase, and light source 48 is shunted, causing it to cease to illuminate, thereby increasing the resistance of photo-resistor 49, and deactuating coil 51. Upon deactuation of coil 51, the contacts 52 are again switched over, causing light 48 to illuminate while resistor 53 is not shunted, and so on. In general, an oscillation is provided of shunting and not shunting resistor 53, which causes an oscillation in the voltage on line 18. This oscillation will continue until the coil 40 is once again energized. With the voltage change in the line 18, the voltage drop across resistor 43 again will change, which is again sensed by the transistor 70, which causes the light source 21 to actuate. Of course, sonic alarm 30 also is actuated at this time. Since the voltage drop across resistor 43 oscillates, the transistor 70 oscillates, and, in turn, the light 21 flashes on and off and the sonic alarm is oscillated on and off. Thus, first-indicating means 21 is operated in the second mode of operation thereof responsive to the second alarm control means 16.

Should one desire to turn on the lights 29 at station 10, one opens the switch 28, which causes the current which is normally supplied to on-transistor 62 through resistors 53, 54 to be terminated, which, in turn, causes energization of the coil 63, which switches the contacts 67, energizing the lights 29. As long as the switch 28 stays open, the lights 29 will be energized, or timing switches may be utilized to maintain the load 29 energized for a predetermined period of time once the switch is open a given length of time.

Upon a third alarm condition being initiated, that is, someone cutting the telephone lines 18, the positive voltage applied to point A is lost. This causes resistor 42 to bias the transistor 41 in a conducting mode, which, in turn, causes the second-indicating light 22 to be energized and the coil 79 to be energized. The light 22 will stay energized as long as the lines 18 are cut since the source 45 provides current for energization thereof, and the energization of coil 79 effects switching of contacts 81, which, in turn, causes current to flow through transistor 83 from source 74, through transistor 85, and to sonic-alarm means 30 to provide actuation thereof. Again, the selective interruption of the sonic-alarm means 30, while the second-indicator light 22 remains on, may be effected by the closing of normally open switch 89.

Should another alarm-initiating condition occur, that is, should the voltage at points A and B reverse (as by someone tampering with the phone lines or phone line trouble), point A would become negative, causing transistor 41 to conduct, and light 22 to illuminate, with sonic alarm 30 actuated by the switching of contacts 81. At the same time, the negative voltage at point A would pass through diode 75 and be applied to the base of transistor 70, causing it to conduct, which would, in turn, cause coil 80 to energize and light 21 to be illuminated until the polarity at points A and B returns to normal.

It will thus be seen that according to the present invention, a simple system has been provided, including only two indicating means, which will sense five different alarm initiating conditions, clearly distinguishing between four of those conditions (the fifth condition being related to one of the four conditions), and allowing control of a load at the protected site from the monitoring site. While the invention has been herein shown and described in what is presently conceived to be the most practical and preferred embodiment thereof, it will be apparent to those of ordinary skill in the art that many modifications thereof may be made within the scope of the invention, which scope is to be accorded the broadest interpretation of the appended claims so as to encompass all equivalent assemblies and devices.

What is claimed is:

1. An alarm system comprising:

a first station in a site to be monitored;

a second station in a site to monitor said first station;

a first alarm control means in said first station;

a second alarm control means in said first station;

phone lines inter-connecting said first station and said second station, and adapted to be connected to a source of DC electric power for applying a voltage thereto;

a first-indicating means in said second station for indicating a first alarm condition by a first mode of operation thereof, and for indicating a second alarm condition by a second mode of operation thereof;

a second-indicating means in said second station for indicating at least a third alarm condition by a mode of operation thereof;

first-circuit means operatively connected to said phone lines for effecting energization of said second-indicating means should the voltage of said phone lines be lost; and second circuit means operatively connected to said phone lines for effecting operation of said first-indicating means in said first mode in response to actuation of said first alarm control means, and for effecting operation of said first-indicating means in said second mode in response to actuation of said second alarm control means.

2. An alarm system as recited in claim 1 wherein said second circuit means includes means for effecting operation of said first-indicating means in said first mode in response to a source of DC current being placed closer to said second station than said first station on said phone lines.

3. An alarm system as recited in claim 2 wherein each of said alarm control means includes condition-sensing means, and wherein said first alarm control means includes intrusion-sensing means.

4. An alarm system as recited in claim 3 wherein said second alarm control means includes fire-sensing means.

5. An alarm system as recited in claim 1 wherein said first-indicating means includes an indicator light and wherein in one mode of operation of said indicator light, it is constantly on, and in another mode of operation of said light, it is flashing on and off.

6. An alarm system as recited in claim 1 wherein said first and second circuit means comprise means for effecting operation of both said first-indicating means and said second-indicating means should the polarity of said phone lines reverse.

7. An alarm system as recited in claim 1 further comprising switch means located in said second station for effecting operation of said second circuit means for energizing a load remote from said second station whether or not said first alarm control means is actuated.

8. An alarm system as recited in claim 1 wherein said second circuit means for effecting energization of said first indicating means in said second mode includes first-circuit component means for oscillating the electrical energy applied to said first-indicating means, said first-circuit component means comprising a light source and a photocell operatively electrically connected to said second alarm control means so that when said second alarm control means is actuated, said light source is periodically actuated and actuation of said light source is sensed by said photocell which then allows sufficient electrical energy to be supplied to said first-indicating means to effect operation therein.

9. An alarm system as recited in claim 1 further comprising second-circuitry component means of said second circuit means for latching said first-indicating means in said first mode in response to actuation of said first-alarm control means.

10. An alarm system as recited in claim 9 further comprising switch means located in said second station for effecting release of said latching of said first-indicating means if said first alarm control means is no longer actuated.

11. An alarm system as recited in claim 10 wherein said switch means in said second station also comprises means for effecting operation of said second circuit means for energizing a load remote from said second station whether or not said first alarm-control means is actuated.

12. An alarm system as recited in claim 11 wherein said load remote from said second station includes illuminating lights at or around said first station.

13. An alarm system as recited in claim 1 further comprising third-indicating means in said second station and means for actuating said third-indicating means whenever said first or second-indicating means are actuated.

14. An alarm system as recited in claim 13 further comprising deactivating means for selectively deactivating said third-indicating means while not deactivating said first and second-indicating means.

15. An alarm system as recited in claim 14 wherein said third-indicating means deactivating means includes a coil operatively associated with said third-indicating actuating means, latching relay contacts associated with said coil, and a manual switch for closing a circuit allowing current from said means for actuating said third-indicating means to flow through said coil.

16. An alarm system as recited in claim 13 further comprising a low voltage DC source for energizing said first, second, and third-indicating means.

17. An alarm system as recited in claim 1 wherein said first-circuit means are located at said second station and include a transistor and a source of DC electric power, of substantially the same voltage as the DC source of electric power adapted to be connected to said phone lines, operatively connected to said transistor.

18. An alarm system as recited in claim 17 wherein said first-circuit means further include a Zener diode for limiting the voltage across said first-indicating means.

19. An alarm system as recited in claim 1 wherein said second-circuit means includes a third-circuit component means, located at said second station, including a transistor, a biasing resistor for said transistor, and a variable resistor means for providing a threshold adjustment for said transistor so that said transistor will conduct upon the sensing of only a small voltage change thereby.

20. An alarm system as recited in claim 19 wherein said third circuit component means includes a resistor connected to said phone lines, and wherein said transistor senses a voltage drop across said resistor.

21. An alarm system comprising a first station in a site to be monitored;

a second station in a site to monitor said first station;

an alarm control means in said first station;

phone lines inter-connecting said first station and said second station, and adapted to be connected to a source of DC electric power for applying a voltage thereto;

indicating means in said second station for indicating an alarm condition;

circuit means operatively connected to said phone lines for effecting operation of said indicating means in response to actuation of said alarm control means, said circuit means including circuit component means located in said first station and circuit component means located in said second station, said circuit component means in said first station including means for latchingly changing the voltage of said phone lines in response to said alarm control means, and said circuit component means in said second station responsive to a change in voltage of said phone lines for effecting operation of said indicating means in a particular mode as long as said change in voltage of said phone lines exists; and switch means located in said second station for effecting operation of said circuit component means in said first station for energizing a load remote from said second station whether or not said alarm control means is actuated.

22. An alarm system as recited in claim 21 wherein said switch means in said second station also comprises means for effecting release of said latching of said voltage change by said circuit component means in said first station if said alarm control means is no longer actuated.

23. An alarm system comprising a first station in a site to be monitored;

a second station in a site to monitor said first station;

an alarm control means in said first station;

phone lines inter-connecting said first station and said second station, and adapted to be connected to a source of DC electric power for applying a voltage thereto;

indicating means in said second station for indicating an alarm condition;

circuit means operatively connected to said phone lines for effecting operation of said indicating means in response to actuation of said alarm control means responsive to voltage changes in said phone lines, said circuit means including circuit component means in said second station, including a resistor connected to said phone lines, a transistor for sensing a voltage drop across said resistor, a biasing resistor for said transistor, and a variable resistor means for providing a threshold adjustment for said transistor so that said transistor will conduct upon a small variation in the voltage drop across said resistor.

* * * * *